US007675822B2

(12) United States Patent
Moritani

(10) Patent No.: US 7,675,822 B2
(45) Date of Patent: Mar. 9, 2010

(54) CLOCK DEVICE, CLOCK SYSTEM, AND TIME MEASURING METHOD

(75) Inventor: Nakanobu Moritani, Chiba (JP)

(73) Assignee: Seiko Precision Inc., Chiba (JP)

( * ) Notice: Subject to any disclaimer, the term of this patent is extended or adjusted under 35 U.S.C. 154(b) by 338 days.

(21) Appl. No.: 11/904,160

(22) Filed: Sep. 26, 2007

(65) Prior Publication Data

US 2008/0074954 A1 Mar. 27, 2008

(30) Foreign Application Priority Data

Sep. 26, 2006 (JP) ..... 2006-259992

(51) Int. Cl.
*G04F 8/00* (2006.01)
*G04B 47/00* (2006.01)
*A63B 69/00* (2006.01)

(52) U.S. Cl. ..... 368/3; 368/10; 368/113; 340/323 R; 702/176

(58) Field of Classification Search ..... 368/2, 368/3, 6, 9, 10, 107, 110, 113; 340/572.1, 340/573.1, 323 R; 342/89, 90; 343/720; 702/79, 142, 149, 150, 176
See application file for complete search history.

(56) References Cited

U.S. PATENT DOCUMENTS 3,587,100 A * 6/1971 Doremus et al. ..... 463/6
4,643,585 A * 2/1987 Hillesland ..... 368/9
5,091,895 A * 2/1992 Chatwin et al. ..... 368/6
5,737,280 A * 4/1998 Kokubo ..... 368/2
7,203,609 B2 * 4/2007 Moritani ..... 702/65
2005/0033548 A1 * 2/2005 Vincenzini ..... 702/150
2005/0203714 A9 * 9/2005 Vincenzini ..... 702/150
2006/0164922 A1 * 7/2006 Forsey et al. ..... 368/110

FOREIGN PATENT DOCUMENTS

| | | |
|---|---|---|
| JP | 61-189483 | 8/1986 |
| JP | 03-137593 | 6/1991 |
| JP | 09-072972 | 3/1997 |
| JP | 2006047263 | 2/2006 |
| JP | 2006-113896 | 4/2006 |

OTHER PUBLICATIONS

Japanese Patent Office Action for Japanese Patent Application No. 2006-259992.

* cited by examiner

*Primary Examiner*—Vit W Miska
(74) *Attorney, Agent, or Firm*—Howard & Howard Attorneys PLLC

(57) ABSTRACT

A clock device is held by a moving body, and receives a modulated wave from two electromagnetic fields generated by an antenna formed in a predetermined shape and disposed on a path. The clock device demodulates the modulated wave and acquires unique identification information. The clock device determines a non-detection period after the identification information is acquired. The clock device acquires a reference time corresponding to a middle of the non-detection period, and specifies the acquired reference time as a pass time when the moving body has passed through a point where the antenna is disposed.

9 Claims, 15 Drawing Sheets

TRANSMISSION WAVEFORM

DEMODULATED WAVEFORM

CLOCK DEVICE, CLOCK SYSTEM, AND TIME MEASURING METHOD

BACKGROUND OF THE INVENTION

1. Field of the Invention

The present invention relates to a clock device, a clock system and a time measuring method which appropriately clock the pass time of a moving body, e.g., the time of an athlete while preventing false detection of an electromagnetic field or the like.

2. Description of the Related Art

Recently, an attempt of measuring (clocking) goal times of individual athletes has been made in marathons. For example, a measuring system, which has a bar-code printed on the number cloth of a runner, and measures the goal time of an individual runner based on a time when the bar-code of the runner who has crossed the goal line is read through a reader, is in practical use.

Nowadays, to measure a competition time including a pass time at a halfway clock point, an attempt of measuring the competition time of an individual runner by a non-contact scheme has been made. For example, a measuring system which causes an athlete to hold a tag transmitter (wireless tag or the like), and measures a competition time through the tag transmitter is developed, and the operational test thereof or the like is attempted for practical usage.

As an example, Unexamined Japanese Patent Application KOKAI Publication No. 2006-47263 (P11 to P25, and FIG. 1) discloses a technology which specifies a measuring time (competition time) by causing a wireless tag, which includes a clock unit and is held by an athlete, to detect a predetermined electromagnetic field.

According to the foregoing technology, as shown in FIG. 9A in detail, a loop coil formed in a shape like figure of 8 is disposed on a course (clock point) through which an athlete runs to generate an electromagnetic field. That is, an electromagnetic field shown in FIG. 9B is generated on the loop coil. The electromagnetic field includes an additional side lobe SL in addition to a main lobe ML used for measurement.

As the athlete reaches the clock point (loop coil) and moves on such an electromagnetic field, the wireless tag detects a point b (trigger point) shown in FIG. 9B through the change of the electromagnetic field, thus measuring a competition time. Information on the measured competition time and the like is transmission data from the wireless tag to a receiver.

According to the foregoing technology, the change of the electromagnetic field (more specifically, detection of a point where the polarity of an electromagnetic field intensity changes) is set as a condition of detecting a trigger point in the electromagnetic field shown in FIG. 9B.

However, in the vicinity of a point a where detection of the electromagnetic field is started, the signal level of the electromagnetic field becomes unstable, so that the wireless tag catches the change, resulting in false detection of a trigger point. Therefore, in practice, an operation of detecting a trigger point is started after a predetermined time has passed from first detection of the electromagnetic field. That is, the wireless tag is set to have a non-detection time, and the operation of detecting a trigger point is started after the non-detection time passes from when the electromagnetic field is detected at first in the vicinity of the point a, so that the point b is detected as the trigger point.

However, every time the abilities of runners (moving speeds on the loop coil) differ, e.g., cases like an international competition and a civic competition, and a men's competition and a women's competition, it is necessary to set the non-detection time in accordance with the abilities of the runners. This is extremely bothersome, thus the non-detection time may be set falsely, and there is a possibility such that setting itself is not carried out at all.

If the electromagnetic field to be generated on the loop coil is not appropriate (too large) and the trigger level of the wireless tag is not appropriate (too low), the side lobe LS may be detected. In this case, even if the non-detection time is set appropriately, the start of the detection operation is so fast that the wireless tag detects the change of the electromagnetic field other than the point b, resulting in false detection of a trigger point.

Further, in a relay competition like a marathon relay race, a person who arrives a point (a runner who has run a previous interval) and a person who departs from the point (a runner who is about to run a current interval) may run on the same loop coil in receiving a cross brace or a baton. At this time, wireless tags of both runners respectively perform transmission of a competition time.

In this case, only the competition time of the person who arrives the point is valid, and it is necessary to discard the competition time transmission data from the person who departs the point. Accordingly, it is necessary to register identification information or the like for identifying the wireless tag of the person who arrives a point beforehand in a reception-side processing device.

The wireless tag of the departing person ever performs unnecessary transmission, and due to a collision with the unnecessary transmission or the like, an adverse effect may be given when the wireless tag of the arriving person transmits a competition time.

SUMMARY OF THE INVENTION

The present invention has been made in view of the foregoing situations, and it is an object of the invention to provide a clock device, a clock system and a time measuring method which appropriately clock the time of an athlete while preventing false detection of an electromagnetic field.

To achieve the object, a clock device according to the first aspect of the invention is a clock device which is held by a moving body and comprises:

a clock unit which clocks a reference time;

a reception unit which receives a modulated wave from two electromagnetic fields generated by an antenna formed in a predetermined shape and disposed on a path through which the moving body passes;

an information acquisition unit which demodulates the modulated wave received by the reception unit, and acquires unique identification information;

a determination unit which determines a non-detection period of an electromagnetic field generated between the two electromagnetic fields after the information acquisition unit acquires the identification information; and a time specifying unit which acquires the reference time corresponding to a middle of the non-detection period determined by the determination unit, and specifies the acquired reference time as a pass time when the moving body passes through a point at which the antenna is disposed.

According to the invention, the clock device is held by a moving body, e.g., an athlete, and the clock unit thereof clocks a reference time (e.g., running time) in a competition. The reception unit receives a modulated wave (as an example, modulated LF signal) from two electromagnetic fields generated by an antenna disposed on a path and formed in, for example, figure of 8. The information acquisition unit demodulates the modulated wave received by the reception unit, and acquires unique identification information (e.g., gate ID). The determination unit determines a non-detection period of an electromagnetic field generated between the two electromagnetic fields after the information acquisition unit acquires identification information. The time specifying unit acquires a reference time corresponding to the middle of the non-detection period determined by the determination unit, and specifies the acquired reference time as a pass time when the moving body (e.g., athlete) has passed through a point where the antenna is disposed, in a word, a competition time.

That is, false detection is prevented by starting determination of a non-detection period (to be more precise, detection of a trigger point) after it becomes possible to receive identification information.

This results in appropriate clocking of the time of an athlete while preventing false detection of an electromagnetic field or the like.

When a period that the electromagnetic field is undetectable reaches a preset reference period, the determination unit may determine that the period is a non-detection period, and the reference period may be set based on a time necessary for a fastest moving body (e.g., runner) assumed beforehand to move a width between the two electromagnetic fields.

The determination unit may determine the non-detection period after the information acquisition unit acquires the identification information plural times.

The clock device may be held by an athlete as the moving body, and the clock unit may clock a reference time in a competition, the reception unit may receive the modulated wave from the two electromagnetic fields generated by the antenna disposed on a course of the competition, and the time specifying unit may specify the pass time as a competition time of the competition.

The clock device may further comprise a memory unit which stores the pass time and the identification information acquired by the information acquisition unit, after the pass time is specified by the time specifying unit.

The determination unit may determine the non-detection period after the information acquisition unit acquires identification information of a second kind.

The identification information may be subjected to Manchester encoding, and superimposed on the modulated wave.

To achieve the object, a clock system according to the second aspect of the invention is a clock system which comprises a clock device held by a moving body, a transmitter that generates an electromagnetic field through an antenna formed in a predetermined shape and disposed on a path through which the moving body passes to transmit predetermined data to the clock device, a receiver which receives time information transmission data from the clock device, and a processing device which processes a pass time of the moving body based on the time information received by the receiver, and wherein the clock device comprises:

a clock unit which clocks a reference time;

a reception unit which receives a modulated wave from two electromagnetic fields generated by the antenna;

an information acquisition unit which decodes data, transmission data from the transmitter, from the modulated wave received by the reception unit, and acquires identification information of the transmitter included in the decoded data;

a determination unit which determines a non-detection period of an electromagnetic field generated between the two electromagnetic fields, after the information acquisition unit acquires the identification information;

a time specifying unit which acquires the reference time corresponding to a middle of the non-detection period determined by the determination unit, and specifies the acquired reference time as a pass time when the moving body passes through a point where the antenna is disposed; and a transmission unit which transmits the time information including the pass time specified by the time specifying unit and identification information of the clock device to the receiver.

The determination unit of the clock device may determine the non-detection period after the information acquisition unit acquires the identification information plural times.

To achieve the object, a time measuring method according to the third aspect of the invention is a time measuring method which is for a clock device held by an athlete, and comprises:

a clock step of clocking a reference time in a competition;

a reception step of receiving a modulated wave from two electromagnetic fields generated by an antenna formed in a predetermined shape and disposed on a course;

an information acquisition step of demodulating the modulated wave received in the reception step, and acquiring unique identification information;

a determination step of determining a non-detection period of an electromagnetic field generated between the two electromagnetic fields after identification information is acquired in the information acquisition step; and a time specifying step of acquiring the reference time corresponding to a middle of the non-detection period determined in the determination step, and specifying the acquired reference time as a competition time.

According to the invention, a reference time in a competition (e.g., a running time) is clocked in the clock step. A modulated wave (as an example, a modulated LF signal) is received from two electromagnetic fields generated by an antenna disposed on a course and formed in a shape like figure of 8 in the reception step. The modulated wave received in the reception step is demodulated to acquire unique identification information (e.g., gate ID) in the information acquisition step. A non-detection period of an electromagnetic field generated between the two electromagnetic fields is determined in the determination step after the identification information is acquired in the information acquisition step. A reference time corresponding to the middle of the non-detection period determined in the determination step is acquired, and the acquired reference time is specified as a competition time in the time specifying step.

That is, false detection is prevented by starting determination of the non-detection period after it becomes possible to receive the identification information.

This results in appropriate clocking of the time of an athlete (e.g., runner) while preventing false detection of an electromagnetic field or the like.

DETAILED DESCRIPTION OF THE PREFERRED EMBODIMENTS

A competition clock system of the embodiment will be explained with reference to the accompanying drawings. An explanation will be given of an example case where the competition clock system is used for a marathon competition.

Figure 1A:
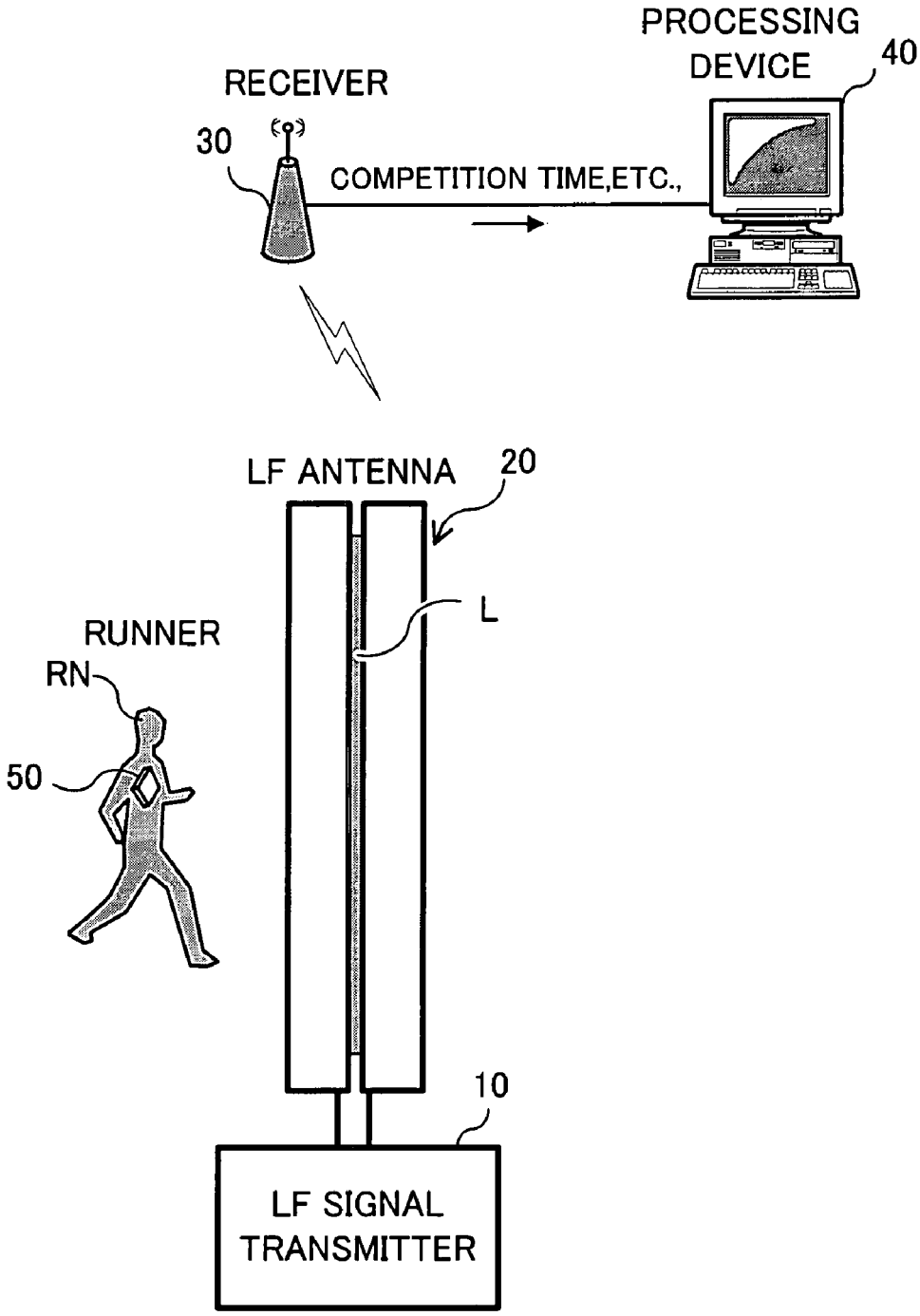
FIG. 1A is an exemplarily diagram showing an example of the structure of a competition clock system according to an embodiment of the invention.

FIG. 1A is an exemplarily diagram showing an example of the structure of the competition clock system according to the embodiment of the invention.

As shown in the figure, the competition clock system comprises an LF signal transmitter 10 which is disposed on a course where a competition is carried out or therearound, an LF antenna 20, a receiver 30, a processing device 40, and a wireless tag 50 which is held by a runner RN.

Note that the LF signal transmitter 10, the LF antenna 20 and the receiver 30 are disposed at individual clock points, clock point by clock point for clocking.

The LF (Low Frequency) signal transmitter 10 is disposed at each clock point set at the roadside of the course. The LF signal transmitter 10 supplies an LF signal to the LF antenna 20 to generate an electromagnetic field, and transmits data to the wireless tag 50 of the runner RN who arrives over the LF antenna 20.

Figure 1B:
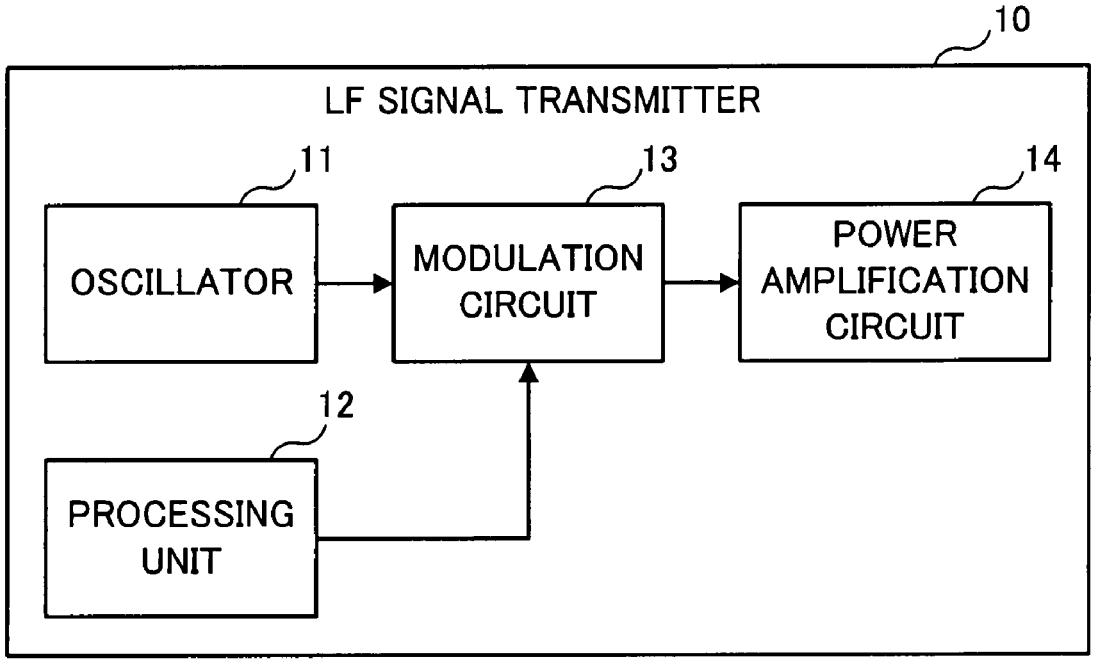
FIG. 1B is a block diagram showing the configuration of an LF SIGNAL TRANSMITTER.

Specifically, the LF signal transmitter 10 comprises an oscillator 11, a processing unit 12, a modulation circuit 13, and a power amplification circuit 14 as shown in FIG. 1B.

The oscillator 11 generates, for example, an LF signal of 125 kHz, and supplies the signal to the modulation circuit 13. That is, the oscillator 11 supplies the LF signal as a carrier signal to the modulation circuit 13.

The processing unit 12 comprises a CPU (Central Processing Unit) or the like, manages information like a gate ID, and controls the modulation circuit 13 to modulate transmission data including the gate ID.

The gate ID is unique identification information allocated to each LF signal transmitter 10 (each clock point). As the wireless tag 50 acquires (receives) the gate ID, the wireless tag 50 can specify a clock point through which the runner RN passes.

The modulation circuit 13 is controlled by the processing unit 12, and superimposes transmission data on a carrier signal by OOK (On/Off keying) modulation scheme. At this time, the modulation circuit 13 always generates a transitionable modulation signal even if 0 or 1 continues in the transmission data by Manchester encoding.

Figure 2A:
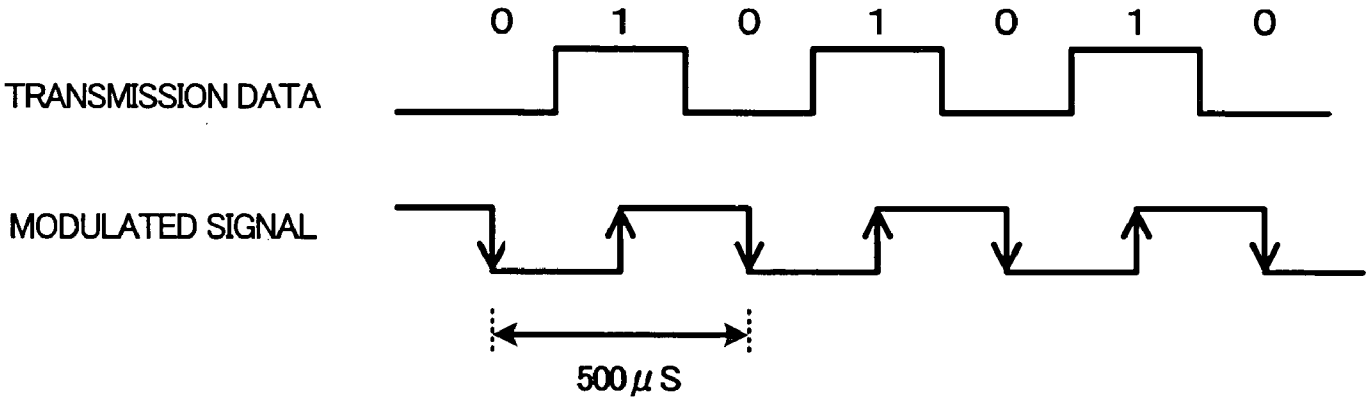
FIGS. 2A to 2D are exemplarily diagrams for explaining Manchester encoding.
Figure 2B:
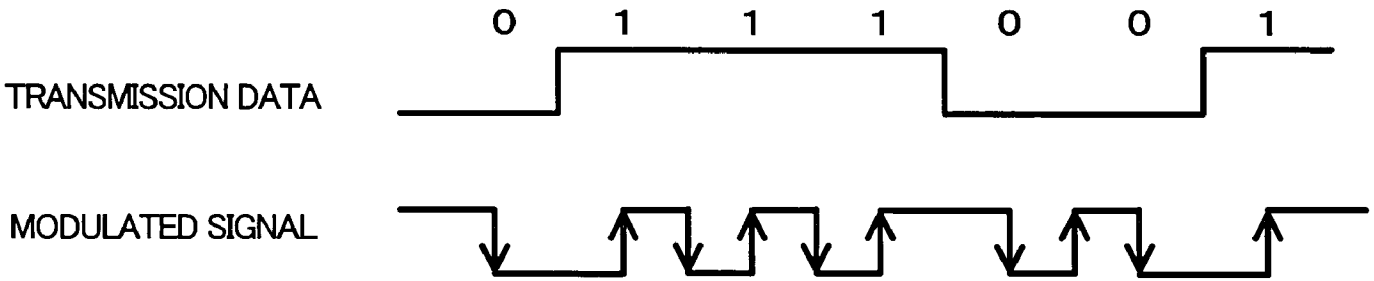
Figure 2C:
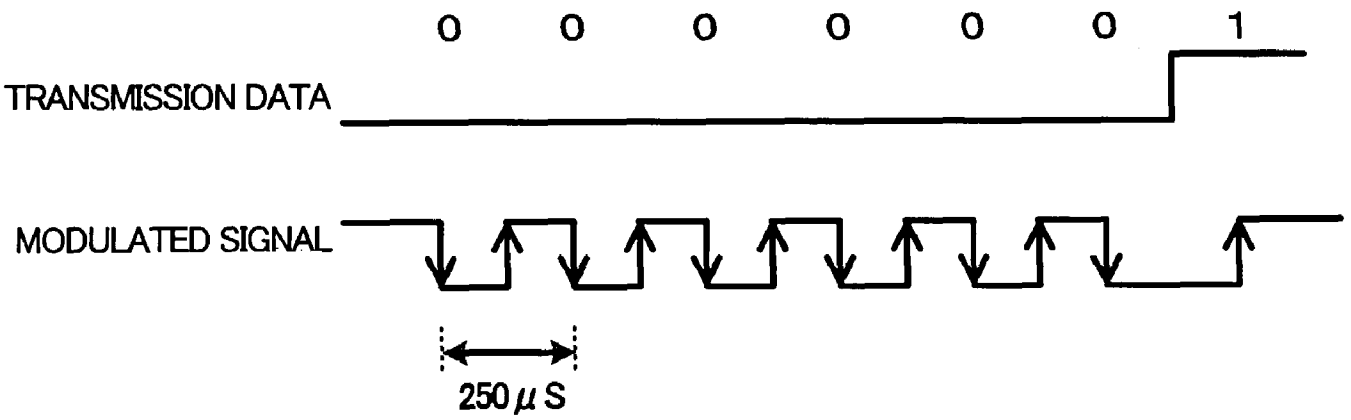
Figure 2D:
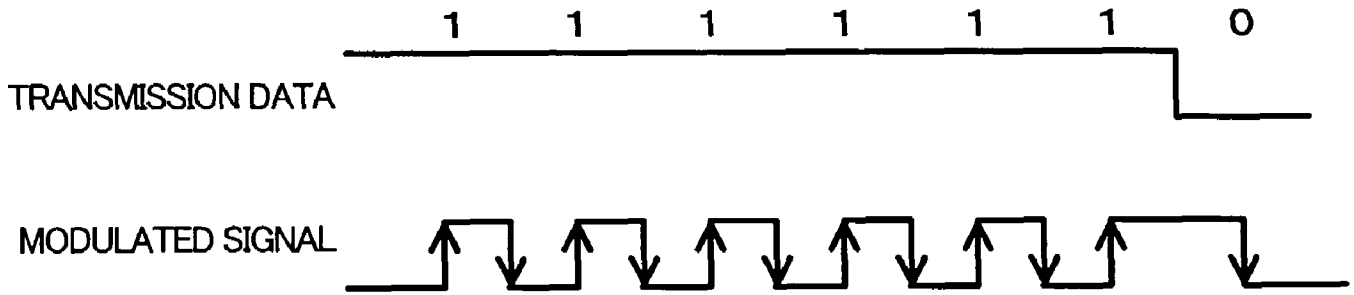

Specifically, the modulation circuit 13 performs Manchester encoding on transmission data as shown in FIGS. 2A to 2D. Providing that the signal speed of the transmission data is 2 kbps, the maximum period of the modulation signal becomes 500 μS (Low period is 250 μS) as shown in FIG. 2A. The minimum period of the modulation signal becomes 250 μS (Low period is 125 μS) as shown in FIG. 2C.

Return to FIG. 1B, the power amplification circuit 14 appropriately amplifies the carrier signal (LF signal) on which the transmission data is superimposed by the modulation circuit 13, and supplies the amplified signal to the LF antenna 20. That is, the power amplification circuit 14 amplifies the signal level of the LF signal to a signal level that the LF signal can be emitted from the LF antenna 20 with a necessary intensity.

Figure 3A:
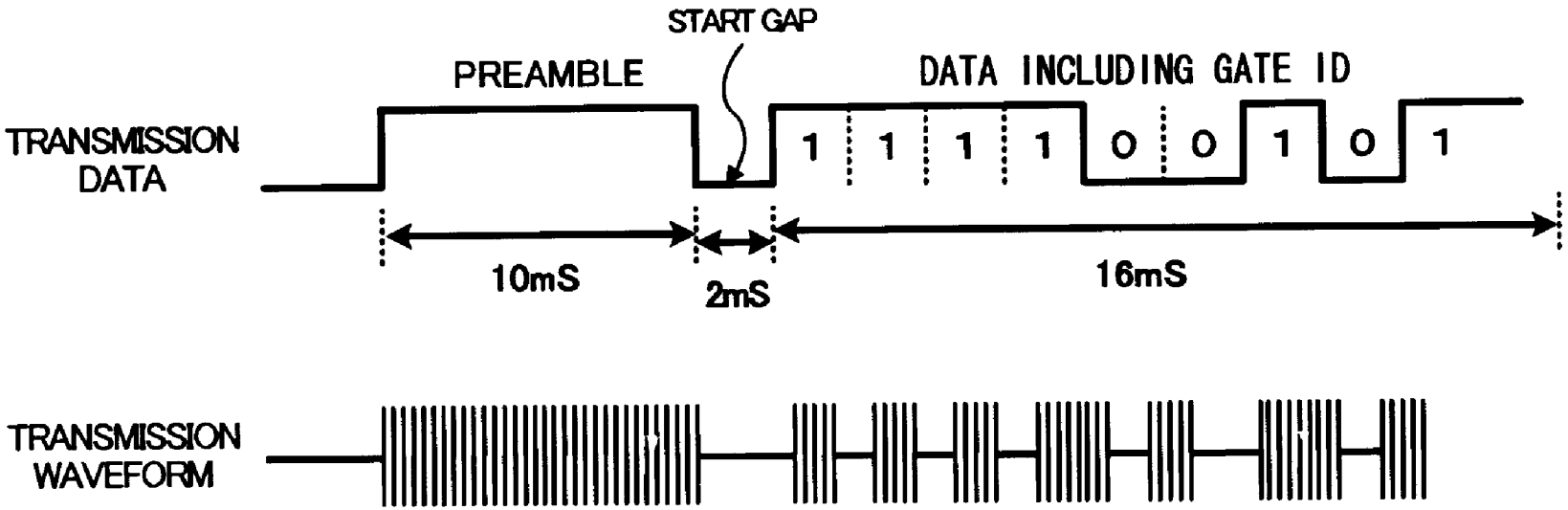
FIG. 3A is an exemplarily diagram for explaining transmission data and modulated transmission waveform.

Specifically, as shown in FIG. 3A, the LF signal transmitter 10 employing such a structure transmits transmission data including a preamble piece, a start gap piece, and a data piece from the LF antenna 20 in a transmission waveform (LF signal) by performing modulation or the like.

The preamble piece is a reference signal (10 mS) used for the wireless tag 50 which receives the transmission data to determine the slice level of the LF signal. The start gap piece is an empty time (2 mS) used for the wireless tag 50 to recognize the start point of data. The data piece includes the above-described gate ID (16 mS).

Figure 3B:
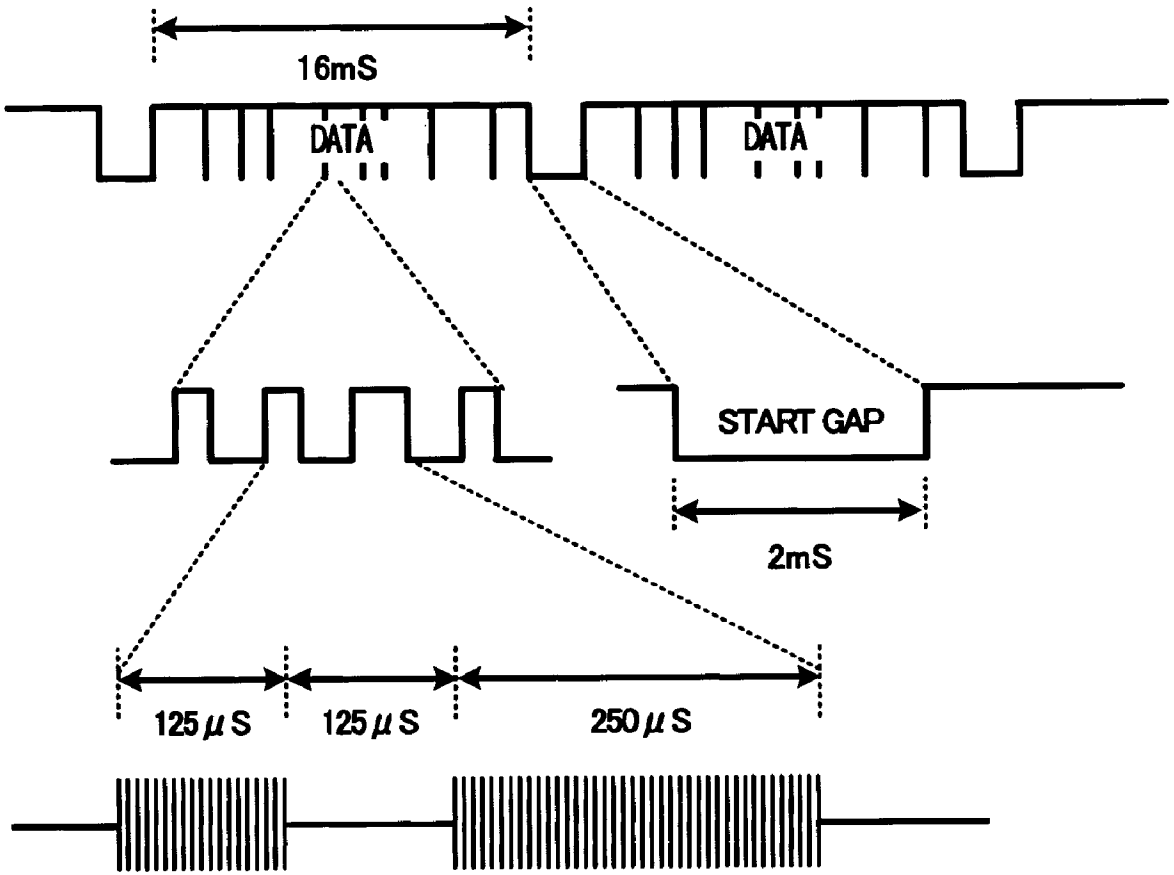
FIG. 3B is an exemplarily diagram for explaining the detail of the transmission waveform.

As shown in FIG. 3B, the start gap piece and the data piece are transmitted repeatedly. At this time, the signal of previous data serves as a preamble piece.

In a case where the signal speed of the transmission data is 2 kbps, the maximum modulation speed of the transmission waveform becomes 4 kbps (minimum modulation speed: 2 kbps).

Return to FIG. 1A, the LF antenna 20 is an antenna (coil) formed in a predetermined shape, and disposed in the course through which the runner RN runs (specifically, at a clock point defined by a clock line L).

Figure 4A:
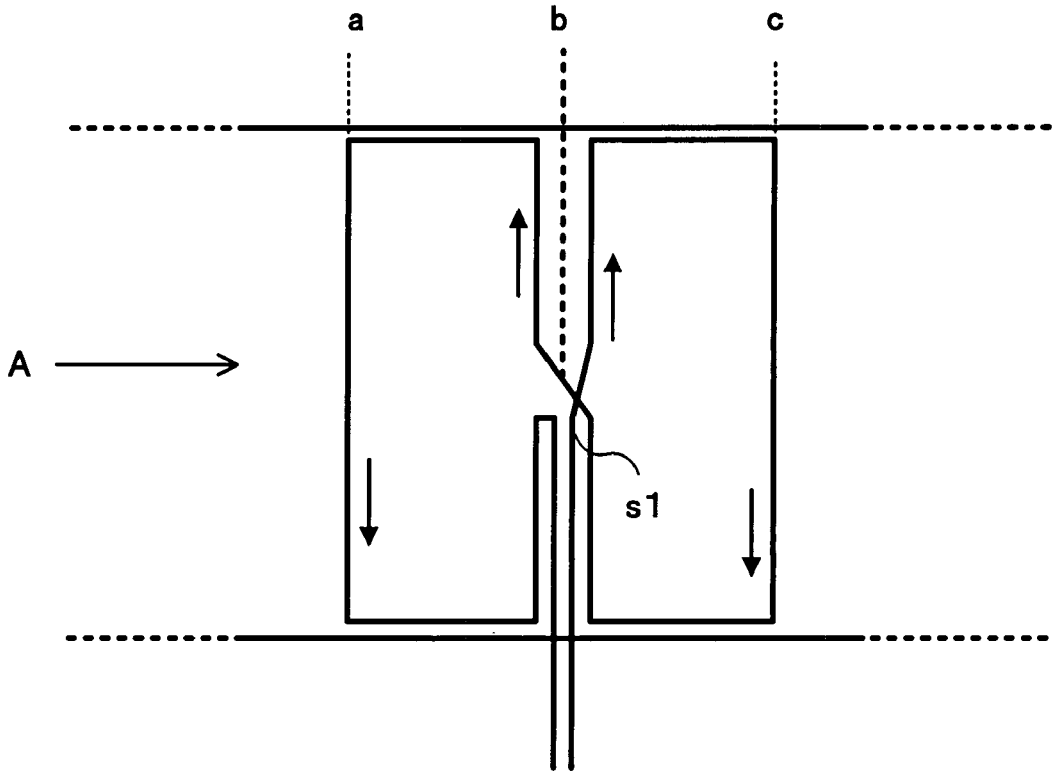
FIG. 4A is an exemplarily diagram showing an example of an LF antenna disposed on a course.

As an example, as shown in FIG. 4A, the LF antenna 20 is formed in a shape like figure of 8 in such a way that two oblong (rectangular) coil portions are disposed successively in the running direction (direction of arrow A) of the runner RN. More specifically, the LF antenna 20 is winded in a forward direction in a shape like figure of 8, and is formed in such a manner as to have a feeding point s1 at the center of, i.e., the intersecting point of the figure of 8.

The top and bottom portions of the figure of 8 are respectively formed along approximately parallel lines a, c spaced away to have a predetermined distance, taking a line b, which passes through the feeding point s1 and extends in a direction orthogonal to the running direction of the runner RN, as a central line.

Note that the LF antenna 20 is disposed in such a way that the clock line L for clocking and the line b are overlapped with each other.

Figure 4B:
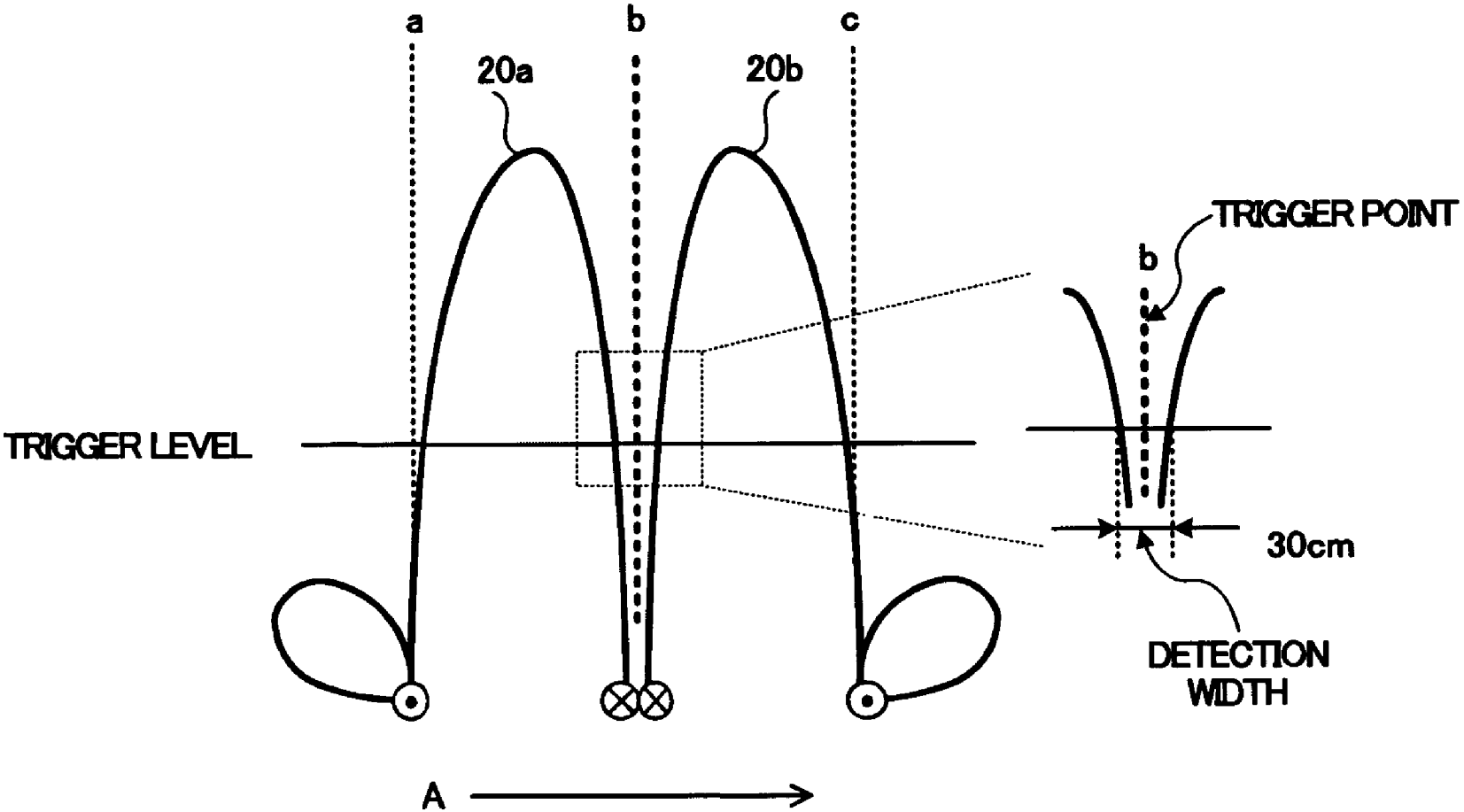
FIG. 4B is an exemplarily diagram showing an example of an electromagnetic field generated on the LF antenna in FIG. 4A.

As the LF signal is supplied from the LF signal transmitter 10, the LF antenna 20 generates electromagnetic fields thereabove. Specifically, as shown in FIG. 4B, a first electromagnetic field 20*a* is generated above the one coil portion, and a second electromagnetic filed 20*b*, which lies next to the first electromagnetic field 20*a* in the running direction of the runner RN (direction of arrow A), and cancels the magnetic force thereof with the first electromagnetic field 20*a*, is generated above the other coil portion.

To cause the wireless tag 50 to surely detect a trigger point (i.e., clock line L overlapped with line b), the electromagnetic fields above the LF antenna 20 are adjusted. For example, at a predetermined height above the clock line L (defined in accordance with a position where the runner RN holds the wireless tag 50), the electromagnetic fields are adjusted in such a way that the wireless tag 50 does not detect an electromagnetic field at a detection width of 30 cm.

Return to FIG. 1A, the receiver 30 is disposed near the LF antenna 20, and receives an RF (Radio Frequency) signal from the wireless tag 50 of the runner RN who passes through the LF antenna 20. The RF signal includes a tag ID for identifying the wireless tag 50, a competition time measured (specified) at a detected trigger point, and the like.

The receiver 30 supplies the received competition time and the like to the processing device 40.

The processing device 40 comprises a personal computer or the like, and tabulates competition times and the like measured by the wireless tag 50.

That is, as receiving an RF signal transmitted from the wireless tag 50 which passes through over the LF antenna 20, through the receiver 30, the processing device 40 stores a competition time and the like included in the RF signal in a predetermined memory unit.

The processing devices 40 may be disposed at respective clock points, and may tabulate only competition times and the like received by the receivers 30 provided at respective clock points. Alternatively, a processing unit 40 may be connected to a plurality of receivers 30 provided at respective clock points through a predetermined network, and the one processing device 40 may handle competition times and the like received by the individual receivers 30.

The wireless tag 50 held by the runner RN is, for example, attached to a number cloth, and moves on the course together with the runner RN. The wireless tag 50 detects a trigger point as an L (Low) period of a certain time continues after a gate ID is acquired from an electromagnetic field generated above the LF antenna 20, and specifies a competition time at the trigger point.

Figure 1C:
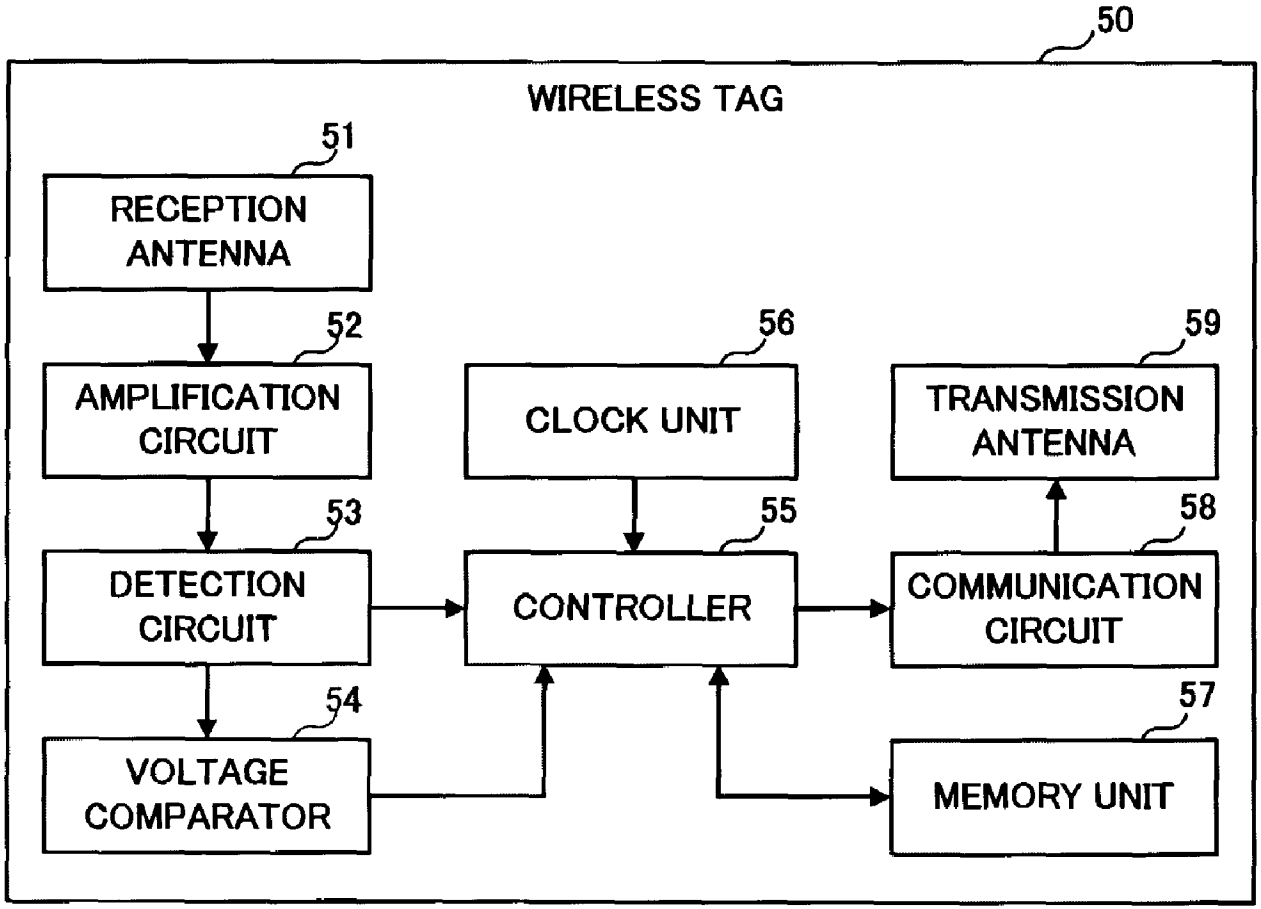
FIG. 1C is a block diagram showing the configuration of a WIRELESS TAG.

As an example, the wireless tag 50 comprises a reception antenna 51, an amplification circuit 52, a detection circuit 53, a voltage comparator 54, a controller 55, a clock unit 56, a memory unit 57, a communication circuit 58, and a transmission antenna 59 as shown in FIG. 1C.

The reception antenna 51 comprises, for example, an antenna in a coil-like shape like a ferrite antenna, and converts an electromagnetic signal into a voltage signal efficiently. Specifically, the reception antenna 51 is set in such a manner that the detection direction of an electromagnetic filed becomes perpendicular to the competition course (i.e., detection coil surface becomes parallel to course), detects an electromagnetic field generated above the LF antenna 20, and receives the modulated LF signal.

The reception antenna 51 supplies the received LF signal (voltage signal) to the amplification circuit 52.

The amplification circuit 52 appropriately amplifies the LF signal supplied from the reception antenna 51. For example, the amplification factor is automatically adjusted with the preamble piece of the LF signal taken as a reference, and the LF signal undergone amplification is supplied to the detection circuit 53.

Figure 5A:
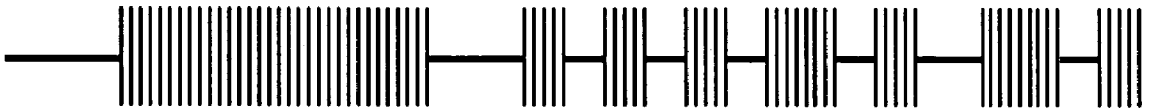
FIG. 5A is an exemplarily diagram showing a transmission waveform.
Figure 5B:
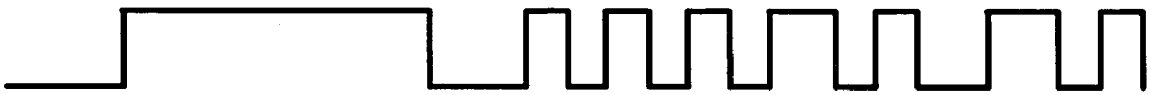
FIG. 5B is an exemplarily diagram showing a demodulated waveform undergone demodulation.

The detection circuit 53 demodulates the modulated LF signal. For example, a signal of a transmission waveform shown in FIG. 5A is demodulated, thereby acquiring a demodulated waveform (demodulated signal) shown in FIG. 5B.

The detection circuit 53 generates a signal indicating presence/absence of electromagnetic field detection based on the LF signal (electromagnetic field intensity), and supplies the signal to the controller 55.

The voltage comparator 54 comprises an A/D converter or the like, and converts a signal demodulated by the detection circuit 53 into digital data that the controller 55 can handle. That is, the voltage comparator 54 digitalizes the demodulated waveform (demodulated signal) shown in FIG. 5B, and supplies the digitalized waveform to the controller 55.

The controller 55 comprises a CPU or the like, and controls the wireless tag 50 entirely.

Specifically, the controller 55 processes the demodulated signal (digital data) supplied from the voltage comparator 54, and decodes data including a gate ID transmission data from the LF signal transmitter 10. At this time, because the data is subjected to Manchester encoding, decoding of the data is also performed.

The controller 55 respectively decodes plural pieces of data successively transmitted to thereby obtain a gate ID. That is, as explained above, because the LF signal transmitter 10 repeatedly transmits start gap pieces and data pieces, the controller 55 successively acquires gate IDs while detecting an electromagnetic field above the LF antenna 20.

Specifically, an explanation will be given of a case where a transmission time of a piece of data from the LF signal transmitter 10 is set to start gap (2 mS)+data (16 mS)=18 mS, and the moving speed of the runner RN is 10 m/S at most (equal to the world record of 100 m run).

Figure 6A:
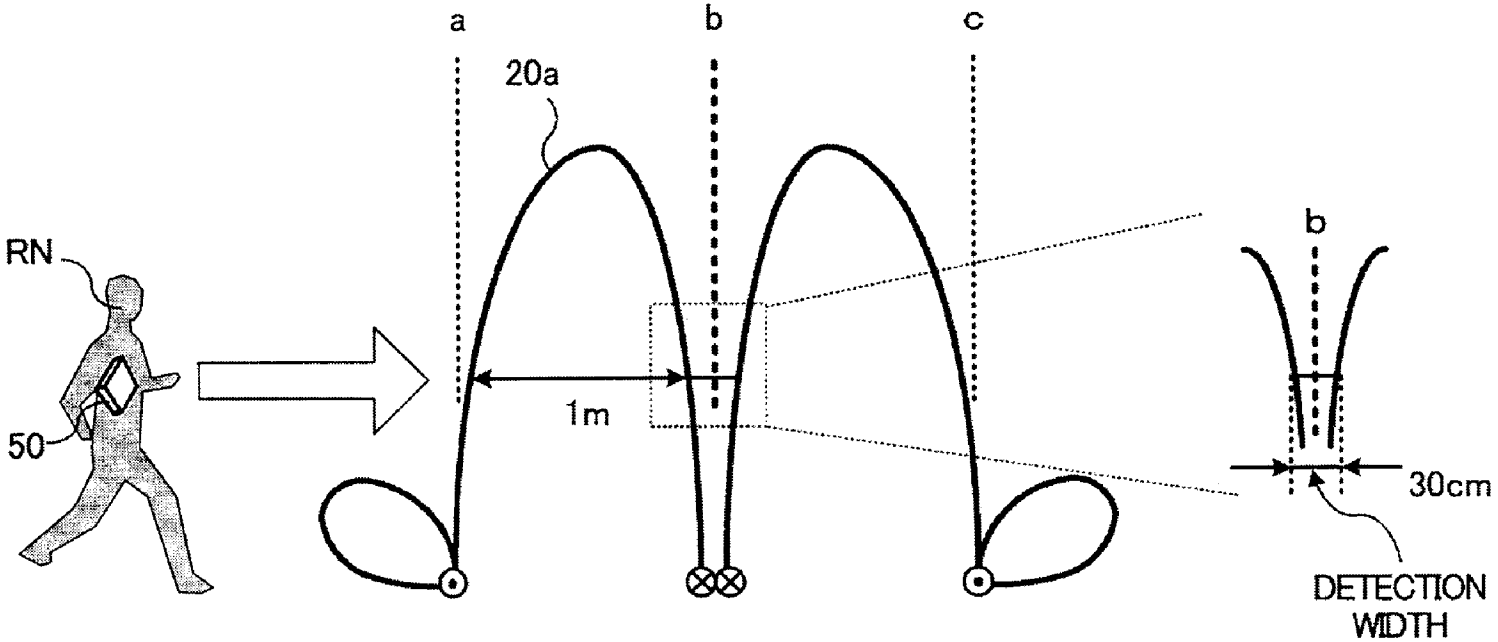
FIG. 6A is an exemplarily diagram for explaining the width of an electromagnetic field.

In this case, as shown in FIG. 6A, as the width of the magnetic field of the first electromagnetic field 20*a* is set to 1 m, the controller 55 performs data reception (acquisition of gate ID) 5.5 times (0.1 S/18 mS) while the runner RN moves that 1 m. In practice, because the moving speed of the runner RN is slower than 10 m/S, the controller 55 performs data reception more than 5.5 times.

Figure 6B:
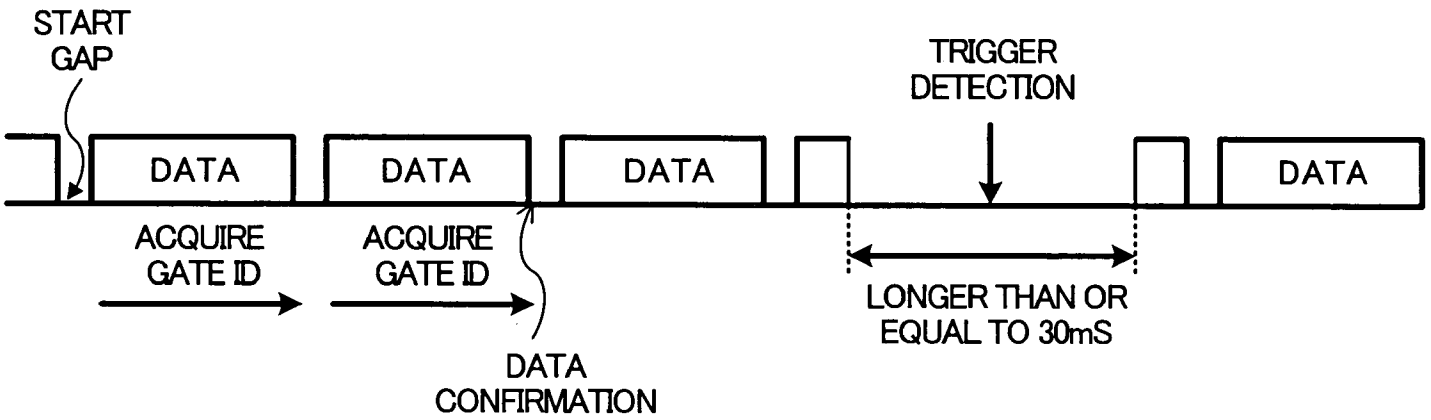
FIGS. 6B and 6C are exemplarily diagrams for explaining the way how trigger detection is performed.

Accordingly, as shown in FIG. 6B, as receiving a gate ID for a plural time, the controller 55 confirms the gate ID as normal data, and then performs determination of an L (Low) period (non-detection period) longer than or equal to 30 mS.

That is, after the data confirmation, the controller 55 acquires a time clocked by the clock unit 56 at a fall timing (high to low) and a time at a rise timing (low to high) of a signal supplied from the voltage comparator 54. Thereafter, if this period (period kept in L) is longer than or equal to 30 mS, the controller 55 determines that this period is a non-detection period.

Figure 6C:
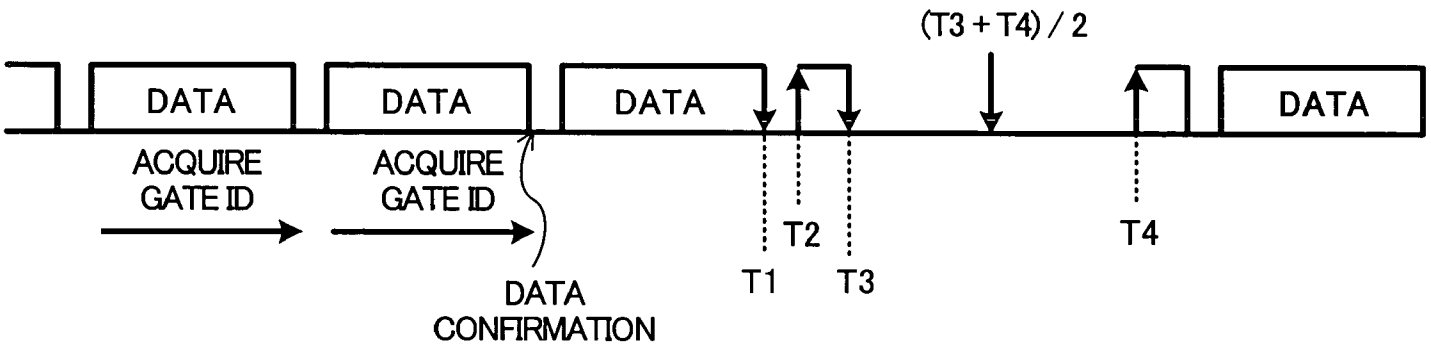

Specifically, as shown in FIG. 6C, the controller 55 acquires a time T1 at a first fall timing after the data confirmation. At a next rise timing, a time T2 is acquired. Because the period (T2−T1) is 2 mS (start gap), the controller 55 determines that this period is not a non-detection period.

Subsequently, the controller 55 acquires a time T3 at a next fall timing. Thereafter, the controller 55 acquires a time T4 at a next rise timing. Because this period (T4−T3) is longer than or equal to 30 mS, the controller 55 determines that this period is a non-detection period.

This 30 mS is a necessary time for the runner RN of the moving speed 10 m/s to move 30 cm shown in FIG. 6A (detection width of trigger point). In practice, because the moving speed of the runner RN is slower than 10 m/S, the controller 55 can determine that the runner RN passes through the clock line L by determining a non-detection period longer than or equal to 30 mS.

Because 30 mS of the non-detection period is extremely large in comparison with a start gap (2 mS), a possibility such that both periods are confused with each other is extremely less, resulting in precise determination.

As detecting such a non-detection period, the controller 55 specifies a middle time of that period as a competition time.

Specifically, as shown in FIG. 6C, the controller 55 acquires a middle time between the time T3 of the detected non-detection period (T4−T3) and the time T4 from an equation (T3+T4)/2, and specifies the middle time as a competition time.

The controller 55 stores the competition time specified in this manner in the memory unit 57 in association with a gate ID.

The clock unit 56 is appropriately adjusted (set) by the controller 55, and clocks a reference time which becomes a reference in the competition.

The clock unit 56 has a highly-stable crystal oscillator so as to maintain the reference time stable.

The memory unit 57 comprises, for example, a non-volatile memory, and stores a competition time and a gate ID specified by the controller 55.

The memory unit 57 has a memory area sufficient to cope with all clock points, and stores competition times and gate IDs specified at all clock points (over LF antennas 20).

The memory unit 57 has another memory area which stores unique identification information (tag ID) allocated to the wireless tag 50 (runner RN).

The communication unit 58 transmits time information including a competition time, a gate ID, and a tag ID to the receiver 30 after the controller 55 specifies the competition time.

For example, the communication unit 58 superimposes time information on an RF signal of 400 MHz, and transmits it through the transmission antenna 59.

The communication unit 58 may be compatible with polling reception through the receiver 30. For example, as receiving transmission request information from the receiver 30 by polling, the communication unit 58 transmits time information to the receiver 30 in response to a request.

The transmission antenna 59 comprises an RF antenna or the like, and emits an RF signal on which time information is superimposed by the communication unit 58 at a predetermined output.

Figure 7:
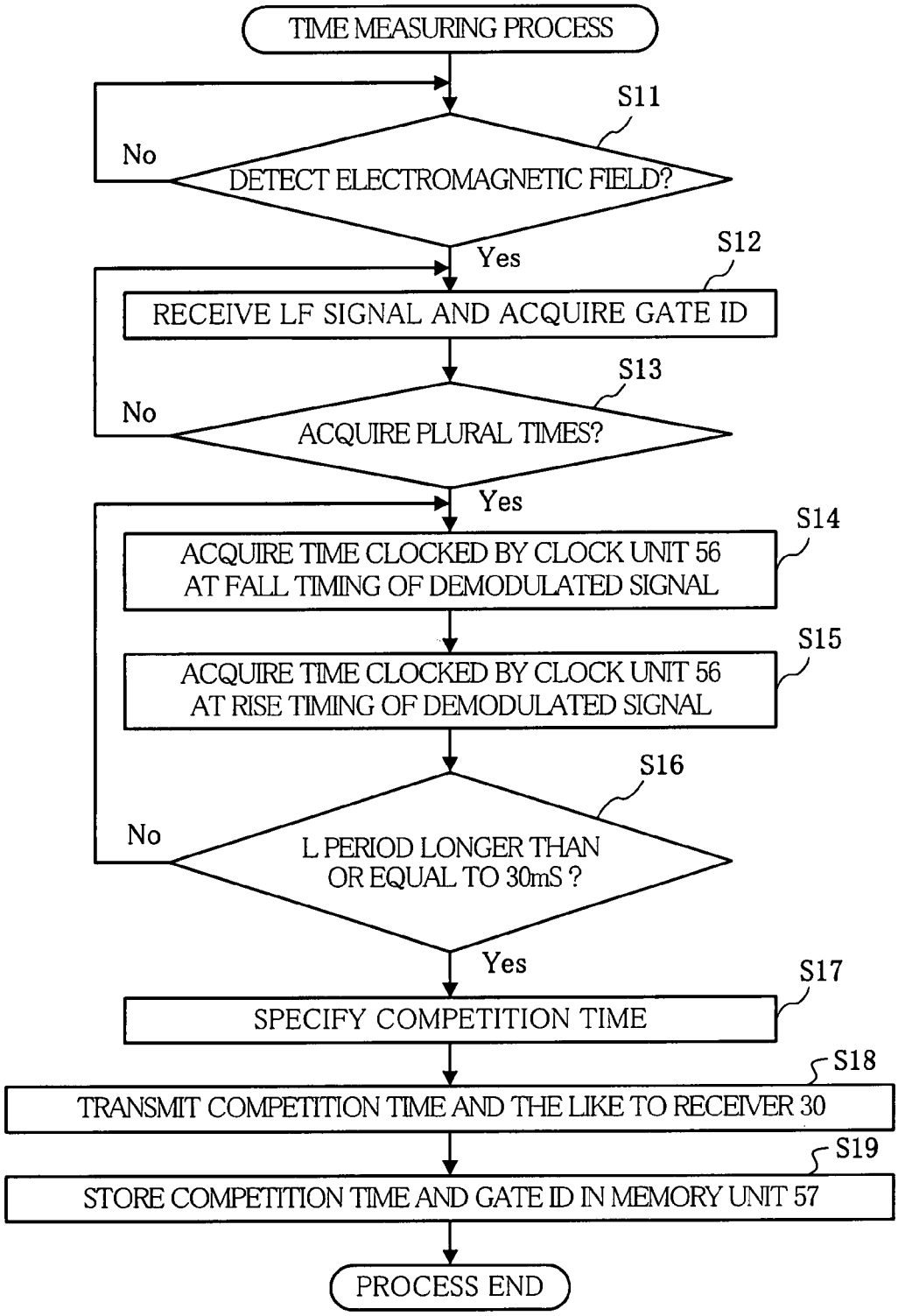
FIG. 7 is a flowchart for explaining a time measuring process according to the embodiment of the invention.

Next, an explanation will be given of the operation of the competition clock system structured as mentioned above with reference to FIG. 7. FIG. 7 is a flowchart for explaining a time measuring process executed by the controller 55 of the wireless tag 50. The time measuring process is executed every time the runner RN reaches a clock point.

First, the controller 55 stands by until an electromagnetic field is detected (step S11). That is, the controller 55 stands by for execution of the following processes until the runner RN reaches over the LF antenna 20 and an electromagnetic field is detected through the reception antenna 51 and the detection circuit 53.

As detecting the electromagnetic field, the controller 55 receives an LF signal through the reception antenna 51, and acquires a gate ID from data demodulated by the detection circuit 53 (step S12). That is, because modulated LF signals are successively transmitted from the LF antenna 20, the controller 55 acquires a gate ID from demodulated data every time data is demodulated by the detection circuit 53.

In starting detection of the electromagnetic field (when the runner RN just reaches over the LF antenna 20), a signal level is unstable, so that a gate ID may be acquired abnormally, but as the runner RN moves over the LF antenna 20, the signal level becomes stable, resulting in normal acquisition of the gate ID.

The controller 55 determines whether or not a gate ID has been acquired plural times (step S13). As mentioned above, because the signal level that the controller 55 receives becomes stable as the runner RN moves over the LF antenna 20, this determination enables the controller 55 to determine whether or not the runner RN moves to a position where the electromagnetic field is stable.

As mentioned above, while the runner RN moves the first electromagnetic filed 20*a* (1 m) shown in FIG. 6A, sufficient pieces (pieces corresponding to at least 5.5 times) of data are successively transmitted from the LF antenna 20.

When determining that the gate ID has not been acquired plural times, the controller 55 repeats the foregoing process at the step S12. That is, the controller 55 acquires a normal gate ID again.

On the other hand, when determining that the gate ID has been acquired plural times, the controller 55 monitors next fall of a demodulated signal, and acquires a time clocked by the clock unit 56 at a fall timing (step S14).

Subsequently, the controller 55 monitors next rise of the demodulated signal, and acquires a time clocked by the clock unit 56 at a rise timing (step S15).

A difference between the time at the rise timing acquired in the step S15 and the time at the fall timing acquired in the step S14 becomes a period that the demodulated signal is kept in L (L period).

The controller 55 determines whether or not the L period is longer than or equal to 30 mS (step S16). That is, the controller 55 determines whether or not the L period is a non-detection period. As mentioned above, by determining a non-detection period of longer than or equal to 30 mS, it is possible to determine whether or not the runner RN has passed through a clock line L.

When having determined that the L period is not longer than or equal to 30 mS (less than 30 mS), the controller 55 returns the process to the step S14, and repeats the processes of the steps S14 to S16. That is, the processes are repeated until a non-detection period is determined.

On the other hand, when having determined that the L period is longer than or equal to 30 mS, the controller 55 specifies a competition time (step S17). That is, a middle time of the non-detection time is acquired, and is specified as a competition time.

Specifically, as shown in FIG. 6C, in a case where a difference between the rise time T4 and the fall time T3 (T4−T3) is longer than or equal to 30 mS, the controller 55 acquires a middle time of that period from (T3+T4)/2, and specifies this time as a competition time.

The controller 55 transmits the competition time and the like to the receiver 30 (step S18). That is, time information including the specified competition time, a gate ID, and a tag ID is superimposed on an RF signal by the communication unit 58, and is transmitted to the receiver 30 through the transmission antenna 59.

The controller 55 stores the specified competition time in the memory unit 57 in association with the acquired gate ID (step S19).

When receiving the RF signal transmitted from the wireless tag 50 through the receiver 30, the processing device 40 stores the competition time and the like included in the RF signal in a predetermined memory unit.

As mentioned above, according to the time measuring process, a scheme of detecting a trigger point using a modulated LF signal (modulated wave) is employed. According to this scheme, at an end of the LF antenna 20 (vicinity of detection start point), the signal level of the modulated wave from the LF signal transmitter 10 may become unstable, and a gate ID superimposed on an LF signal may not be received normally. However, as the runner RN moves over the LF antenna 20, the signal level becomes stable, resulting in normal reception of the gate ID.

According to the time measuring process of the embodiment, detection of a trigger point is started after the gate ID is normally received (i.e., after gate ID is acquired plural times), thereby preventing false detection of a trigger point.

As a result, it is possible to clock the time of the runner RN appropriately while preventing false detection of an electromagnetic field or the like.

Another Embodiment

In the foregoing embodiment, although the explanation has been given of the case where the invention is applied to a marathon competition, the invention can be appropriately applied to other competitions, e.g., a relay competition like a marathon relay race.

For example, in a relay competition like a marathon relay race, in passing/receiving a cross brace or a baton, an arriving person (runner RN who has run a previous interval) and a departing person (runner RN who is about to run a current interval) may run on the same LF antenna 20.

In this case, only the competition time of the arriving person should be available, so that it is desirable that a wireless tag 50 of the departing person should not perform data transmission or the like.

Therefore, in the case of a relay competition like a marathon relay race, a wireless tag 50 may specify a competition time and transmit a competition time and the like when acquiring two kinds of gate IDs.

Figure 8:
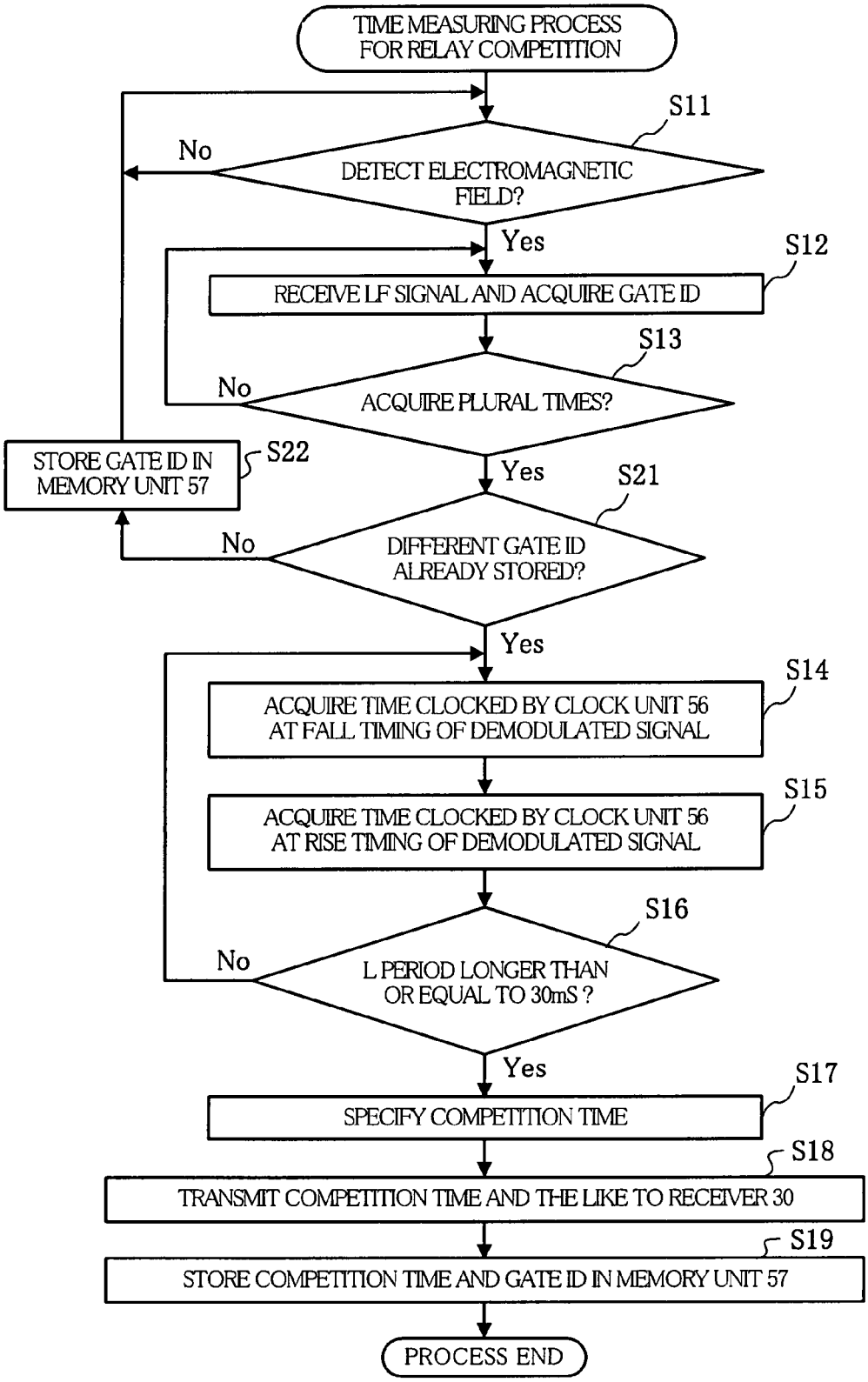
FIG. 8 is a flowchart for explaining a time measuring process for a relay competition according to an another embodiment of the invention.
Figure 9A:
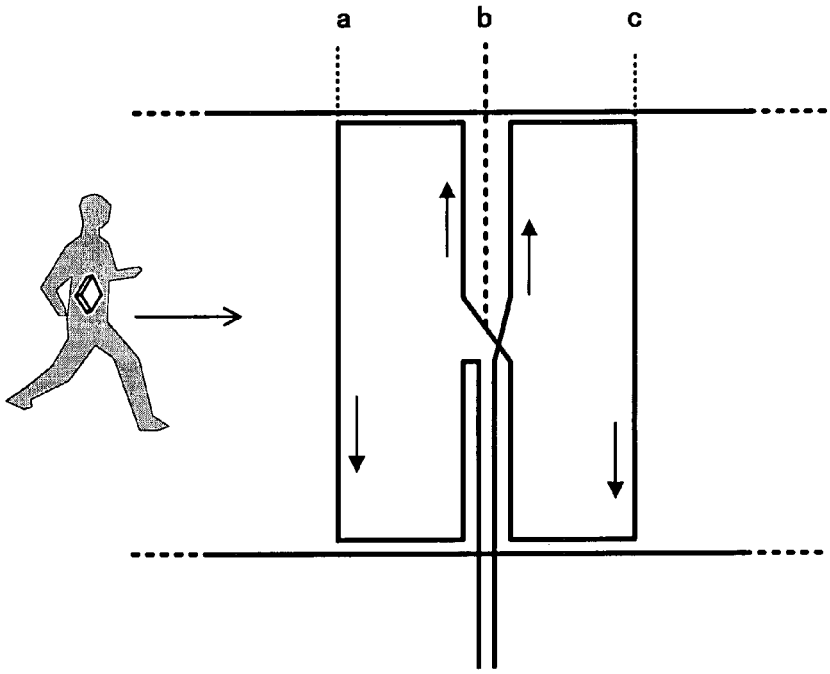
FIGS. 9A and 9B are exemplarily diagrams for explaining the prior art.
Figure 9B:
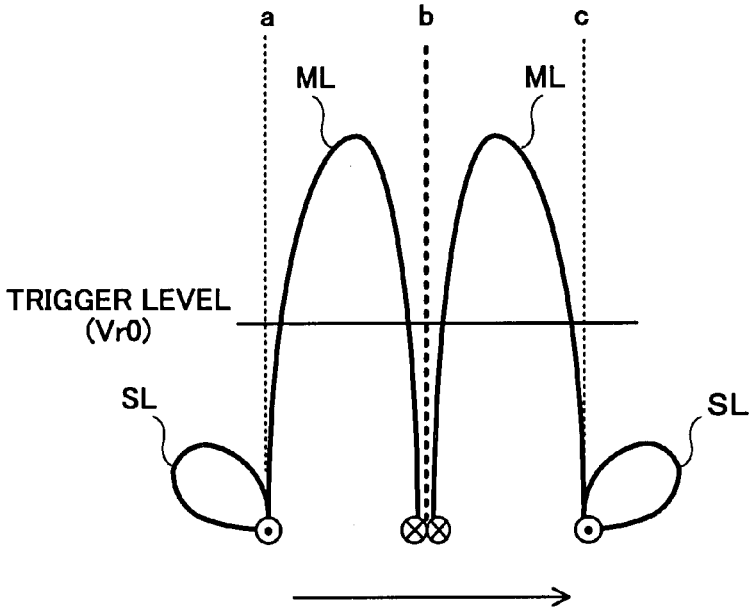

Specifically, the wireless tag 50 (controller 55) executes the time measuring process for a relay competition shown in FIG. 8. This time measuring process is what processes of steps S21 and S22 are added to the time measuring process of FIG. 7.

Hereinafter, the time measuring process of FIG. 8 will be explained.

First, the controller 55 stands by until an electromagnetic field is detected (step S11), and as detecting the electromagnetic field, the controller 55 receives an LF signal through the reception antenna 51, and acquires a gate ID from data demodulated by the detection circuit 53 (step S12).

The controller 55 determines whether or not gate ID is acquired plural times (step S13), and when having determined that the gate ID is acquired plural times, the controller 55 determines whether or not a different gate ID has already stored (step S21). That is, it is determined whether or not a runner RN has already passed through over another LF antenna 20 (over LF antenna 20 at a time of start).

If a different gate ID has been already stored, that runner RN is an arriving person, and if a different gate ID has not stored, that runner RN is a departing person.

When having determined that a different gate ID is not stored, the controller 55 stores the acquired gate ID in the memory unit 57 (step S22). That is, because the departing person passes through over an LF antenna 20, a gate ID acquired from the LF antenna 20 is stored.

The controller 55 returns the process to the step S11. That is, until the runner RN reaches an LF antenna 20 of a next clock point, processes after the step S14 will not be executed.

On the other hand, when having determined in the step S21 that a different gate ID is stored, the process progresses to processes following the step S14.

That is, the controller 55 acquires a time at a next fall timing of a demodulated signal from the clock unit 56 (step S14), and then acquires a time at a next rise timing of the demodulated signal from the clock unit 56 (step S15). The controller 55 determines whether or not an L period is longer than or equal to 30 mS (step S16).

When having determined that the L period is longer than or equal to 30 mS, the controller 55 specifies a competition time (step S17), and transmits time information including the specified competition time and the like to the receiver 30 (step S18).

The controller 55 stores the competition time in the memory unit 57 in association with the acquired gate ID (step S19).

As mentioned above, according to the time measuring process for a relay competition, only a wireless tag 50 which has acquired two kinds of gate IDs specifies a competition time, and transmits the competition time and the like.

Accordingly, it is possible to prevent the wireless tag 50 from transmitting an unnecessary RF signal, thus avoiding congestion of radio waves.

As mentioned above, according to the invention, it is possible to clock a time of a runner appropriately while preventing false detection of an electromagnetic field or the like.

Although a wireless tag 50 of the foregoing embodiments executes a process of storing a specified competition time and an acquired gate ID in a memory unit 57, this process is not an essential process to achieve the object of the invention. However, the wireless tag 50 which holds a competition time and an acquired gate ID brings an advantage such that the invention can cope with a case where the processing device 40 is defected.

In the foregoing embodiments, the explanations have been given of the competition clock system which uses the wireless tag 50 held by an athlete in a marathon competition or the like as an example to explain the invention, but the invention is not limited to this case, and can be applied to various clock systems which cause a moving body to hold a clock device to clock a pass time of the moving body.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application claims a priority based on Japanese Patent Application No. 2006-259992 filed on Sep. 26, 2006, and the contents of which are all incorporated in this specification.

What is claimed is:

1. A clock device held by a moving body, comprising:

a clock unit which clocks a reference time;

a reception unit which receives a modulated wave from two electromagnetic fields generated by an antenna formed in a predetermined shape and disposed on a path through which the moving body passes;

an information acquisition unit which demodulates the modulated wave received by said reception unit, and acquires unique identification information;

a determination unit which determines a non-detection period of an electromagnetic field generated between the two electromagnetic fields after said information acquisition unit acquires the identification information; and a time specifying unit which acquires the reference time corresponding to a middle of the non-detection period determined by said determination unit, and specifies the acquired reference time as a pass time when the moving body passes through a point at which the antenna is disposed.

2. The clock device according to claim 1, wherein when a period that the electromagnetic field is undetectable reaches a preset reference period, said determination unit determines that the period is a non-detection period, and the reference period is set based on a time necessary for a fastest moving body assumed beforehand to move a width between the two electromagnetic fields.

3. The clock device according to claim 1, wherein said determination unit determines the non-detection period after said information acquisition unit acquires the identification information plural times.

4. The clock device according to claim 1 held by an athlete as the moving body, and wherein said clock unit clocks a reference time in a competition, said reception unit receives the modulated wave from the two electromagnetic fields generated by the antenna disposed on a course of the competition, and said time specifying unit specifies the pass time as a competition time of the competition.

5. The clock device according to claim 1, further comprising a memory unit which stores the pass time and the identification information acquired by said information acquisition unit, after the pass time is specified by said time specifying unit.

6. The clock device according to claim 1, wherein the identification information is subjected to Manchester encoding, and is superimposed on the modulated wave.

7. A clock system comprising a clock device held by a moving body, a transmitter that generates an electromagnetic field through an antenna formed in a predetermined shape and disposed on a path through which the moving body passes to transmit predetermined data to said clock device, a receiver which receives time information transmission data from said clock device, and a processing device which processes a pass time of the moving body based on the time information received by said receiver, and wherein said clock device comprises:

a clock unit which clocks a reference time;

a reception unit which receives a modulated wave from two electromagnetic fields generated by the antenna;

an information acquisition unit which decodes data, transmission data from said transmitter, from the modulated wave received by said reception unit, and acquires identification information of said transmitter included in the decoded data;

a determination unit which determines a non-detection period of an electromagnetic field generated between the two electromagnetic fields, after said information acquisition unit acquires the identification information;

a time specifying unit which acquires the reference time corresponding to a middle of the non-detection period determined by said determination unit, and specifies the acquired reference time as a pass time when the moving body passes through a point where the antenna is disposed; and a transmission unit which transmits the time information including the pass time specified by said time specifying unit and identification information of said clock device to said receiver.

8. The clock system according to claim 7, wherein said determination unit of said clock device determines the non-detection period after said information acquisition unit acquires the identification information plural times.

9. A time measuring method for a clock device held by an athlete, comprising:

a clock step of clocking a reference time in a competition;

a reception step of receiving a modulated wave from two electromagnetic fields generated by an antenna formed in a predetermined shape and disposed on a course;

an information acquisition step of demodulating the modulated wave received in said reception step, and acquiring unique identification information;

a determination step of determining a non-detection period of an electromagnetic field generated between the two electromagnetic fields after identification information is acquired in said information acquisition step; and a time specifying step of acquiring the reference time corresponding to a middle of the non-detection period determined in said determination step, and specifying the acquired reference time as a competition time.

* * * * *